US006722089B2

(12) United States Patent
Budzinski

(10) Patent No.: US 6,722,089 B2
(45) Date of Patent: Apr. 20, 2004

(54) CONCEALED STRUCTURAL MULLION

(75) Inventor: Emory Michael Budzinski, Cummings, GA (US)

(73) Assignee: Peachtree Doors, Inc., Norcross, GA (US)

( * ) Notice: Subject to any disclaimer, the term of this patent is extended or adjusted under 35 U.S.C. 154(b) by 0 days.

(21) Appl. No.: 10/152,196

(22) Filed: May 21, 2002

(65) Prior Publication Data

US 2003/0217523 A1 Nov. 27, 2003

(51) Int. Cl.[7] ..... E06B 3/00

(52) U.S. Cl. ..... 52/204.5; 52/204.1; 52/204.62; 52/656.5; 52/730.3; 52/204.67; 52/656.6; 52/734.2

(58) Field of Search ..... 52/204.5, 204.1, 52/235, 204.62, 656.5, 730.3, 734.1, 204.6, 206.67, 656.6, 730.4, 734.2

(56) References Cited

U.S. PATENT DOCUMENTS

| | | | | |
|---|---|---|---|---|
| 3,340,663 A | | 9/1967 | Collard | |
| 3,758,997 A | | 9/1973 | Vance | |
| 4,280,309 A | * | 7/1981 | Huelsekopf | 52/204.54 |
| 4,663,896 A | | 5/1987 | Dunnick | |
| 4,894,973 A | | 1/1990 | Over | |
| 5,435,106 A | | 7/1995 | Garries et al. | |
| 5,570,548 A | * | 11/1996 | Hopper | 52/204.5 |
| 5,839,236 A | | 11/1998 | Frey | |
| 5,937,597 A | | 8/1999 | Sono et al. | |
| 6,360,498 B1 | * | 3/2002 | Westphal | 52/204.5 |

FOREIGN PATENT DOCUMENTS

| | | | |
|---|---|---|---|
| JP | 6-288149 | * 10/1994 | E06B/1/36 |
| JP | 6-307160 | * 11/1994 | E06B/1/60 |

* cited by examiner

*Primary Examiner*—Carl D. Friedman
*Assistant Examiner*—Chi Q Nguyen
(74) *Attorney, Agent, or Firm*—Price, Heneveld, Cooper & DeWitt & Litton

(57) ABSTRACT

A mullion for providing structural support between a pair of adjacent window frames includes a first member having a planar section affixable to a first window frame, a first portion of a first coupler extending outwardly from the planar section of the first member, and a first portion of a second coupler extending outwardly from the planar section of the first member. The mullion also includes a second member having a planar section affixable to a second window frame, a second portion of the first coupler extending outwardly from the planar section of the second member and adapted to couple with the first portion of the first coupler, and a second portion of the second coupler extending outwardly from the planar section of the support member and adapted to couple with the first portion of the second coupler.

25 Claims, 6 Drawing Sheets

CONCEALED STRUCTURAL MULLION

BACKGROUND OF THE INVENTION

The present invention relates to a structural mullion, and in particular to a structural mullion providing high structural rigidity, concealment after assembly, and compatibility with window designs presently utilized.

Centrally located framing structures are used in a wide variety of window applications. These framing elements typically include a separate structural member mounted within the associated window frame between a pair of adjacent windows as part of the building structure. To provide sufficient structural rigidity to resist wind pressure and the like, these structural members are typically bulky, thereby requiring a large gap between the windows. In addition, these structural members require that the adjacent window be mounted separately.

Other window components are typically required to improve the aesthetic appearance of the window assembly. Components such as mullions are utilized to cover gaps between the windows and hide structural components, but typically do not provide structural reinforcement in and of themselves.

SUMMARY OF THE INVENTION

One aspect of the present invention is to provide a mullion for providing structural support between a pair of adjacent window frames that includes a first member having a planar section affixable to a first window frame, a first portion of a first coupler extending outwardly from the planar section of the first member, and a first portion of a second coupler extending outwardly from the planar section of the first member. The mullion also includes a second member having a planar section affixable to a second window frame, a second portion of the first coupler extending outwardly from the planar section of the second member and adapted to couple with the first portion of the first coupler, and a second portion of the second coupler extending outwardly from the planar section of the support member and adapted to couple with the first portion of the second coupler.

Another aspect of the present invention is to provide a window assembly that includes a first window frame, a second window frame, and a mullion. The mullion includes a first member having a planar section affixed to the first window frame, a first portion of a first coupler extending outwardly from the planar section of the first member, and a first portion of a second coupler extending outwardly from the planar section of the first member. The mullion also includes a second member having a planar section affixed to the second window, a second portion of the first coupler extending outwardly from the planar section of the second member and coupled with the first portion of the first coupler, and a second portion of the second coupler extending outwardly from the planar section of the support member and coupled with the first portion of the second coupler. The present inventive structural mullion provides increased structural rigidity to the associated window assembly, a more durable window assembly able to withstand higher stress loads thereon, has an uncomplicated design and a low manufacturing cost. Further, the inventive structural mullion can be easily and quickly assembled within the associated window assembly, and is particularly well adapted for the proposed use.

The present inventive structural mullions provide increased structural integrity between horizontally and vertically adjacent mounted windows. The mullions provide an uncomplicated design, reduced manufacturing costs, are efficient to use and install, and allow for easy prefabrication of window assemblies that include a plurality of windows either at the place of manufacture or on-site. Further, the present inventive mullions increase the operating life of the associated window assemblies, and are particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
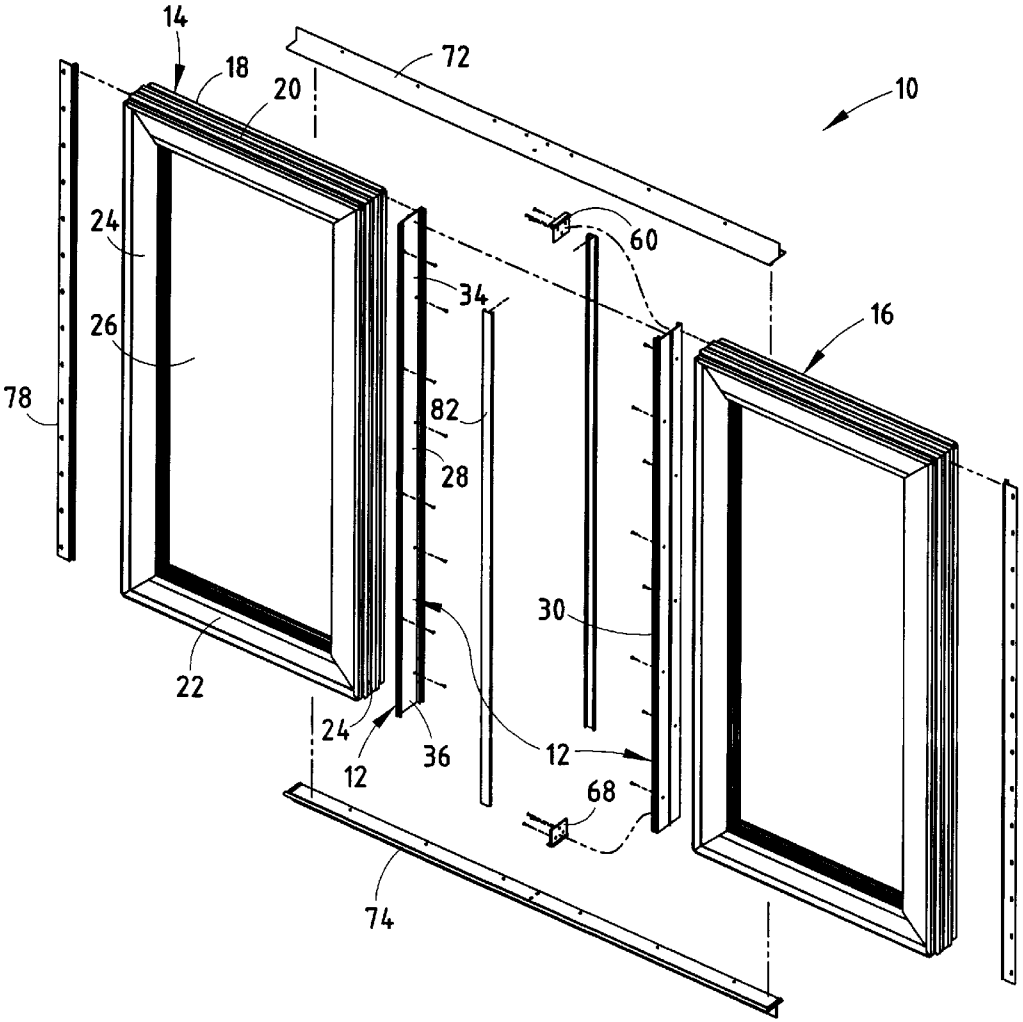
FIG. 1 is an exploded perspective view of a window assembly incorporating a structural mullion embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
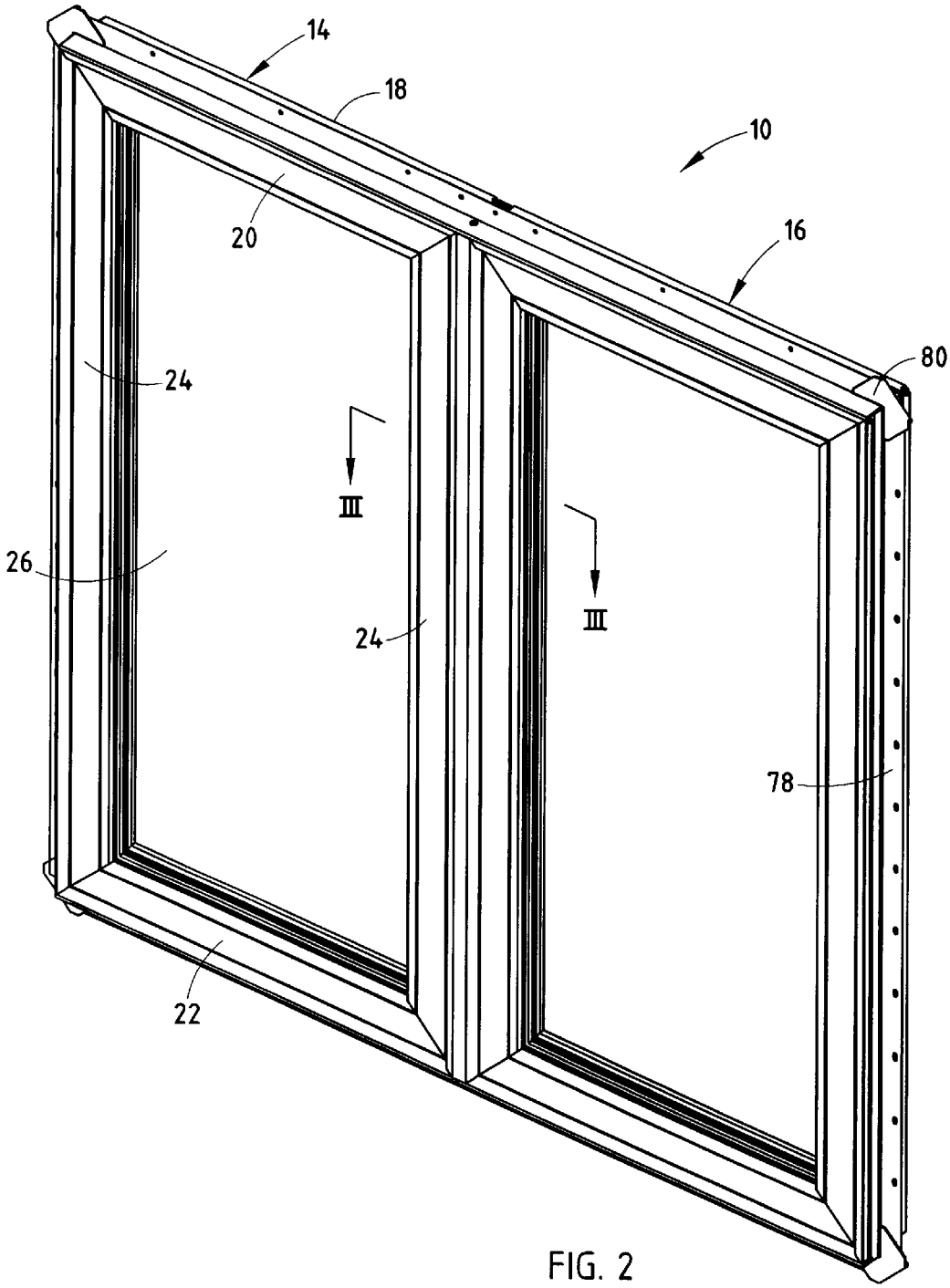
FIG. 2 is a perspective view of the window assembly in an assembled state.

The reference numeral 10 (FIGS. 1 and 2) generally designates a window assembly that includes a mullion 12 embodying the present invention. In the illustrated example, window assembly 10 includes a first window 14 and a second window 16. Each window 14 and 16 include an outer frame 18 having a top frame member 20, a bottom frame member 22 and side frame members 24 that house a glass pane 26 therein.

The mullion 12 (FIG. 3) include a first member 28 and a second member 30. It should be noted for purposes of description herein that first member 28 and second member 30 are identical in structure, therefore, a description of first member 28 should be considered a description of both members 28 and 30. First member 28 (FIG. 4) of mullion 12 includes an elongated, substantially planar body section 32 having a first end 34, a second end 36, a first edge 38 and a second edge 40. First member 28 further includes a pair of fingers 42 extending outwardly from body section 32, located proximate edge 38 and extending longitudinally along first member 28. The pair of fingers 42 includes an outer finger 44 having an outwardly disposed channel 45 extending therealong, and an inner finger 46. Fingers 44 and 46 cooperate to form a channel 48 therebetween. Channel 48 includes an expanded gap or retainment area 50 having an increased diameter from the rest of channel 48 and located proximate body section 32. First member 28 further includes a flange 52 extending outwardly from body section 32 of first member 28, located proximate second edge 40 and extending longitudinally along body section 32. Flange 52 is provided with an enlarged head 54 located at a distal end thereof and adapted to be snappingly received within retainment area 50 of corresponding second member 30. First member 28 also includes a centrally located tab 55 extending outwardly from planar section 32. Tab 55 extends longitudinally along first member 28 and is juxtaposed across planar section 32 from fingers 42 and flange 52. In the illustrated example, first member 28 and second member 30 are constructed of an extruded aluminum, however, other materials and methods of manufacture may be utilized that are suitable for the proposed application.

Figure 5:
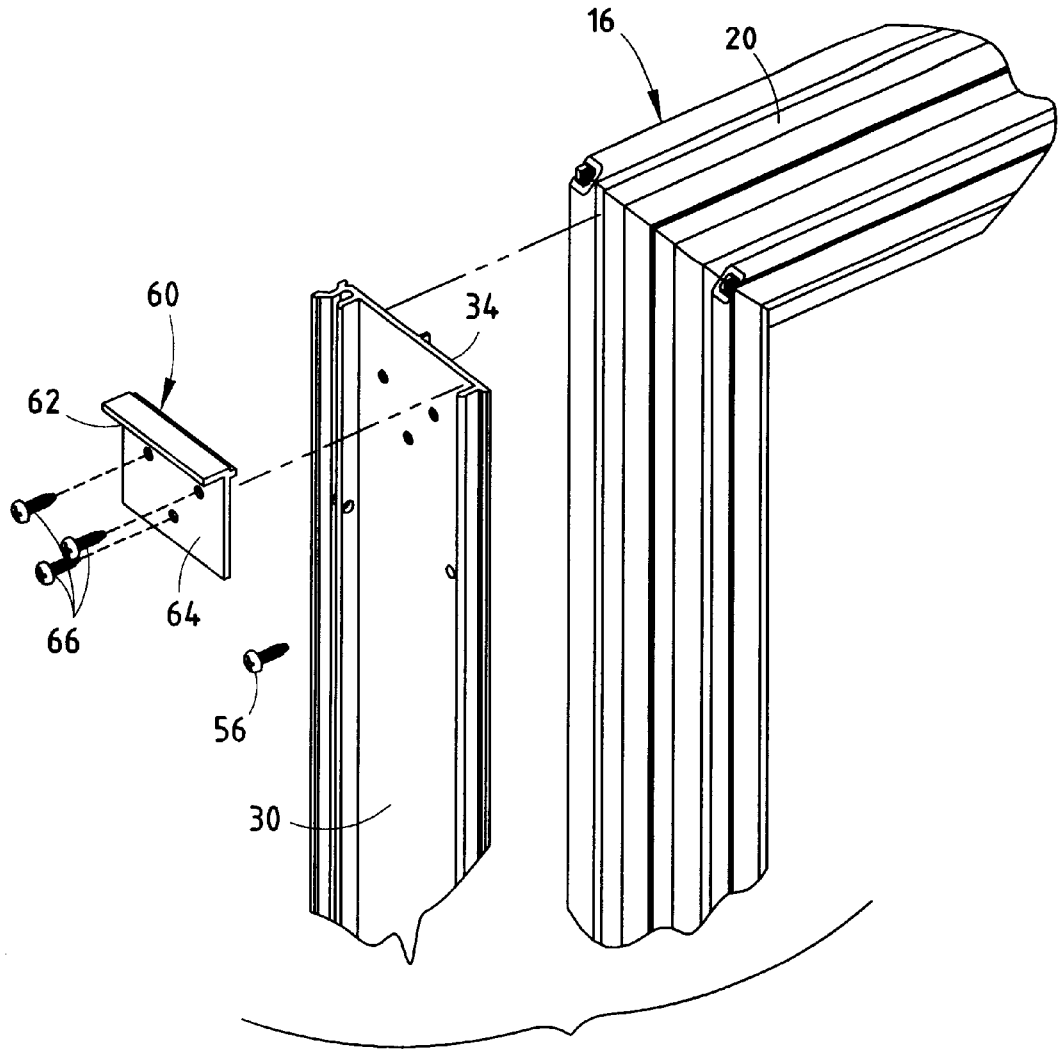
FIG. 5 is an exploded perspective view of a window frame, the portion of the mullion and an anchor plate.

In assembly, second member 30 (FIG. 5) of mullion 12 is fixedly attached to a side frame member 24 of second window 16 via a plurality of machine screws 56, such that body section 32 of second member 30 abuts side frame member 24 and tab 55 of first member 28 is located within an alignment channel 58 extending longitudinally along side frame member 24 of second window 16. First member 28 is fixedly attached to a side frame member 24 of first window 14 in similar fashion.

An L-shaped top anchor plate 60 having an upper portion 62 and a lower portion 64 is affixed to second member 30 of mullion 12 and side frame member 24 of second window 16 approximate first end 34 of second member 30 via a plurality of machine screws 66, such that upper portion 62 extends towards first window 14 when window assembly 10 has been assembled. A bottom anchor plate 64 similar in construction to top anchor plate 60 is affixed to second member 30 of mullion 12 and side frame member 24 of second window 16 in similar fashion. It should be noted that anchor plates 60 and 62 may be affixed to either first window 14 or second window 16.

Figure 3:
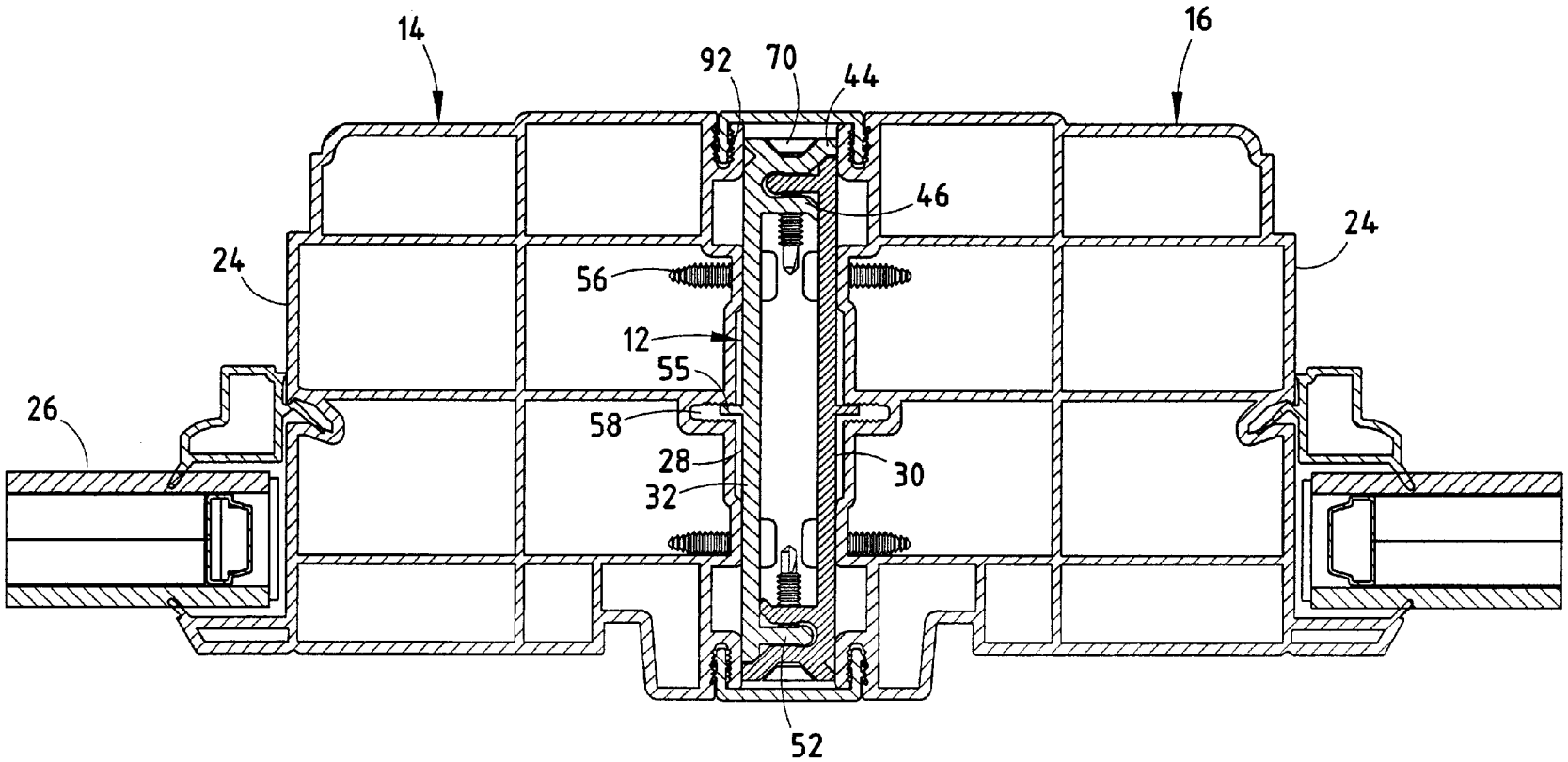
FIG. 3 is a cross-sectional top view of a pair of window frames of the window assembly and the mullion disposed therebetween, taken along the line III—III, FIG. 2.
Figure 4:
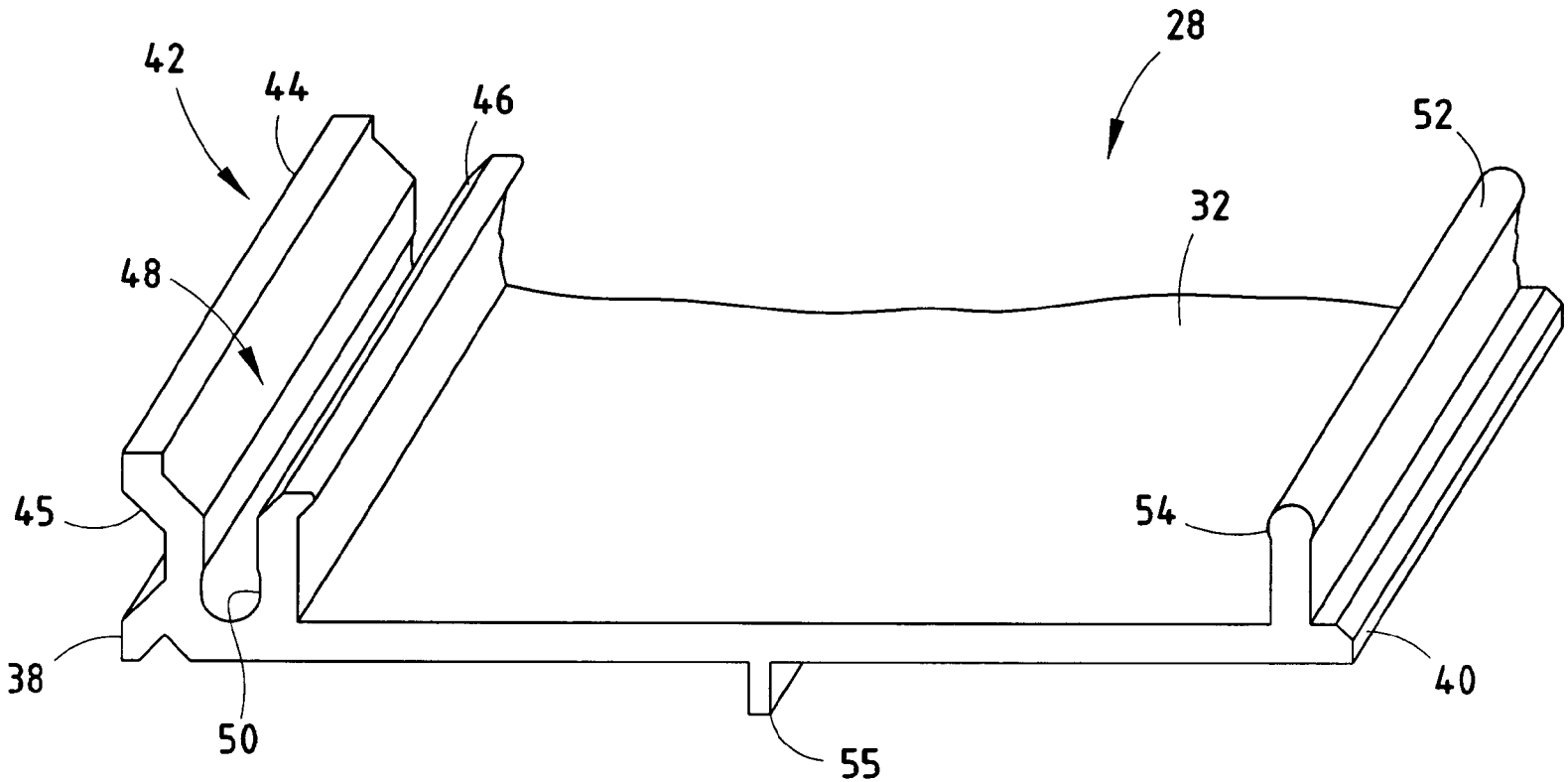
FIG. 4 is a perspective top view of a portion of the mullion.

As best illustrated in FIG. 3, first member 28 and second member 30 of mullion 12 are brought into agreement until flange 52 of each member 28 and 30 is located within channel 48 of each member 28 and 30, respectively. In assembly, head 54 of each flange 52 is snappingly received within retainment area 50 of channel 48 of each member 28 and 30, respectively, as outer finger 44 and inner finger 46 of members 28 and 30 are allowed to slightly flex as flange 52 is located within channel 48 of each member 28 and 30. Alternatively, a plurality of self-tapping machine screws 70 may be located within channel 45 of outer finger 44, and extended through outer finger 44, inner finger 46 and the corresponding flange 52, thereby retaining flange 52 within channel 48.

Figure 6:
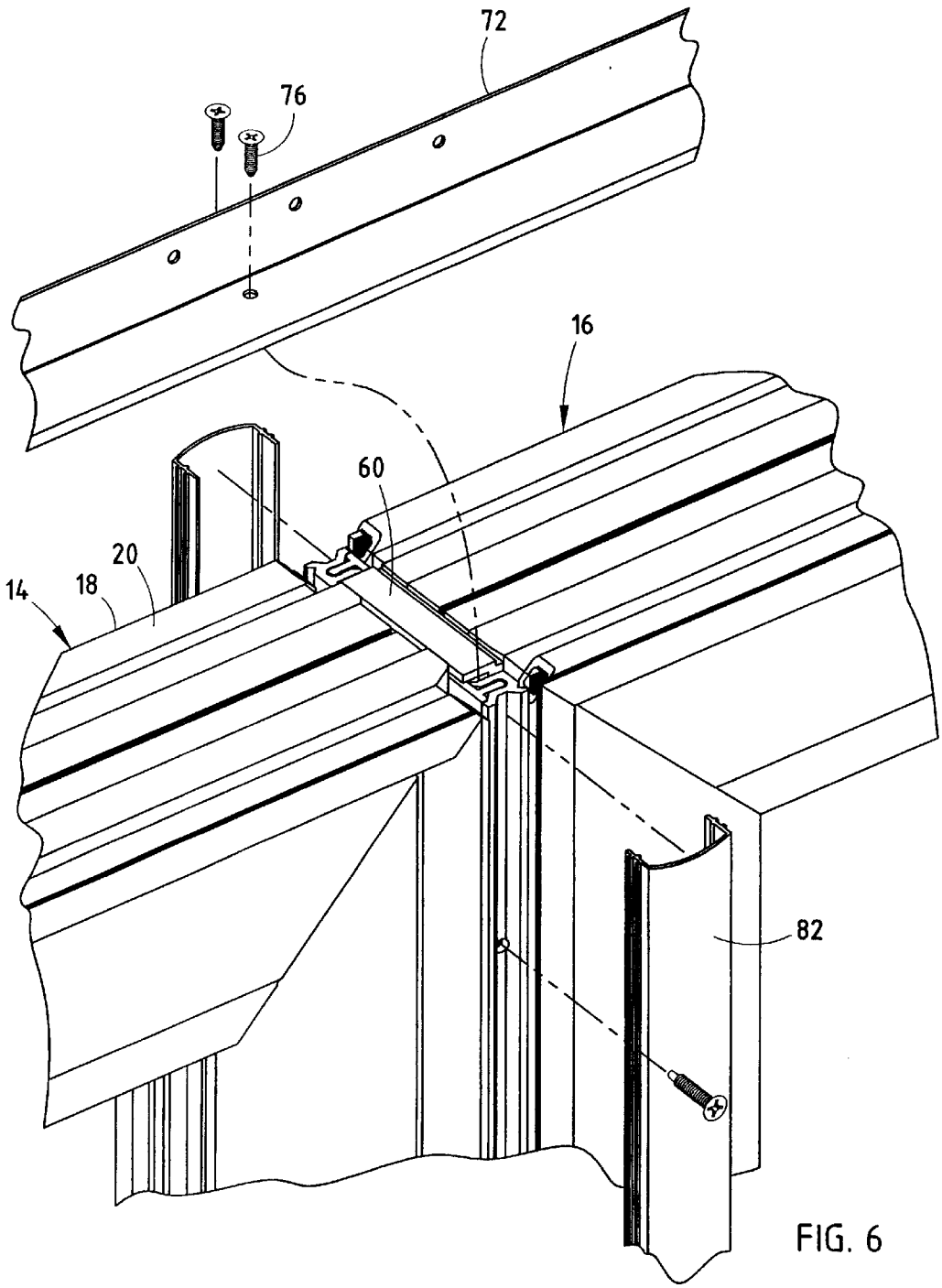
FIG. 6 is a perspective view of a pair of assembled window frames with the mullion disposed therebetween.

The window assembly 10 (FIG. 1) further includes an upper structural support member or drip cap 72 and a lower structural support member 74. Top structural support member 72 (FIG. 6) extends along top frame members 20 of first window 14 and second window 16 and is fixedly attached to top anchor plate 60 via a pair of self tapping machine screws 76. Structural support member 74 extends along bottom frame members 22 of first window 14 and second window 16 and is fixedly attached to bottom anchor plate 68 in similar fashion. A pair of mounting brackets 78 extend along the sides and are fixedly attached to the outer side frame members 24 of first window 14 and second window 16, and are coupled with structural support members 72 and 74 via metal clips 80.

Figure 7:
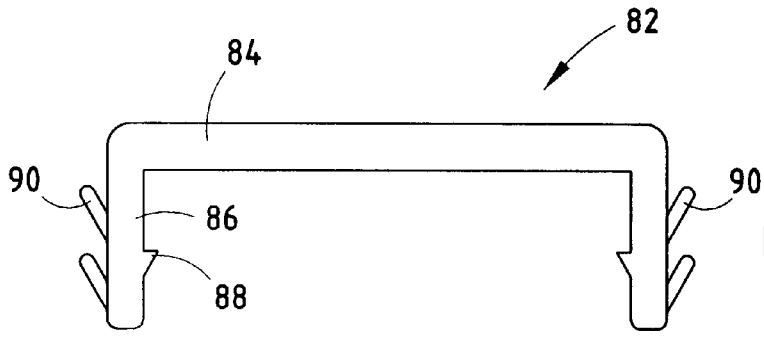
FIG. 7 is a top view of a mullion cap.

A pair of C-shaped mullion covers 82 (FIG. 7) are located between first window 14 and second window 16 and over first edge 38 of first member 28 and second member 30, thereby aesthetically covering mullion 12 from view. Specifically, each cover 82 includes a planar body section 84 and pair of legs 86 juxtaposed thereacross and extending outwardly therefrom. Each leg 86 includes an inwardly extending engagement tab 88 and a pair of outwardly extending engagement fingers 90. As best illustrated in FIG. 3, tab 88 and fingers 90 of each cover 82 is snappingly received within a pair of channels 92 located within side frame members 24 of first window 14 and second window 16, thereby affixing covers 82 to window assembly 10.

Although in the illustrated example mullion 12 and the components associated therewith are used for purposes of mulling, and extend vertically between a pair of windows, similar construction and methods may be used for purposes of stacking or vertically orienting windows, thereby using mullion 12 and the components associated therewith in a horizontal orientation.

The present inventive structural mullions provide increased structural integrity between horizontally and vertically adjacent mounted windows. The mullions provide an uncomplicated design, reduced manufacturing costs, are efficient to use and install, and allow for easy prefabrication of window assemblies that include a plurality of windows wither at the place of manufacture or on-site. Further, the present inventive mullions increase the operating life of the associated window assemblies, and are particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention is claimed is:

1. A mullion for providing structural support between a pair of adjacent window frames, comprising:

a first member having a planar section affixable to a first window frame, a first portion of a first coupler extending outwardly from the planar section of the first member, and a first portion of a second coupler extending outwardly from the planar section of the first member; and a second member having a planar section affixable to a second window frame, a second portion of the first coupler extending outwardly from the planar section of the second member and adapted to couple with the first portion of the first coupler, and a second portion of the second coupler extending outwardly from the planar section of the second member and adapted to couple with the first portion of the second coupler, thereby coupling the first member with the second member and limiting movement of the first member with respect to the second member in a direction substantially transverse to the planar sections of the first and second members.

2. The mullion of claim 1, wherein a selected one of the first portion of the first coupler and the second portion of the first coupler includes a pair of fingers, and the remaining of the first portion of the first coupler and the second portion of the first coupler includes a flange adapted to be received between the pair of fingers of the first coupler, and wherein a selected one of the first portion of the second coupler and the second portion of the second coupler includes a pair of fingers, and the remaining of the first portion of the second coupler and the second portion of the second coupler includes a flange adapted to be received between the pair of fingers of the second coupler.

3. The mullion of claim 2, wherein the fingers and the flanges of the first and second couplers extend longitudinally along the first and second members, respectively.

4. The mullion of claim 3, wherein the flange of the first coupler is snappingly receivable between the pair of fingers of the first coupler, and wherein the flange of the second coupler is snappingly receivable between the pair of fingers of the second coupler.

5. The mullion of claim 4, wherein each flange includes an expanded head at a distal end, and wherein each of the pairs of fingers define an expanded gap located therebetween and adapted to snappingly receive the expanded head of each flange therein, respectively.

6. The mullion of claim 1, wherein the first portion of the first coupler and the second portion of the first coupler are adapted to be snappingly coupled, and wherein the first portion of the second coupler and the second portion of the second coupler are adapted to be snappingly coupled.

7. The mullion of claim 1, wherein the first and second members are adapted to extend substantially an entire length of the associated window frames.

8. A window assembly, comprising:

a first window frame;

a second window frame; and a mullion including a first member and a second member, the first member having a planar section affixed to the first window frame, a first portion of a first coupler extending outwardly from the planar section of the first member, and a first portion of a second coupler extending outwardly from the planar section of the first member, the second member having a planar section affixed to the second window frame, a second portion of the first coupler extending outwardly from the planar section of the second member and coupled with the first portion of the first coupler, and a second portion of the second coupler extending outwardly from the planar section of the second member and coupled with the first portion of the second coupler, thereby coupling the first member with the second member and limiting movement of the first member with respect to the second member in a direction substantially transverse to the planar sections of the first and second members.

9. The window assembly of claim 8, wherein a selected one of the first portion of the first coupler and the second portion of the first coupler includes a pair of fingers, and the remaining of the first portion of the first coupler and the second portion of the first coupler includes a flange received between the pair of fingers of the first coupler, and wherein a selected one of the first portion of the second coupler and the second portion of the second coupler includes a pair of fingers, and the remaining of the first portion of the second coupler and the second portion of the second coupler includes a flange received between the pair of fingers of the second coupler.

10. The window assembly of claim 9, wherein the fingers and the flanges of the first and second couplers extend longitudinally along the first and second members, respectively.

11. The window assembly of claim 10, wherein the flange of the first coupler is snappingly received between the pair of fingers of the first coupler, and wherein the flange of the second coupler is snappingly received between the pair of fingers of the second coupler.

12. The window assembly of claim 11, wherein each flange includes an expanded head at a distal end, and wherein each of the pairs of fingers define an expanded gap located therebetween and adapted to snappingly receive the expanded head of each flange therein, respectively.

13. The window assembly of claim 12, wherein the first member extends substantially an entire length of the first window frame, and wherein the second member extends substantially an entire length of the second window frame.

14. The window assembly of claim 13, further including:

a first L-shaped anchor plate affixed to a select one of the first window frame and the second window frame proximate a first end of the first and second members; and a second L-shaped anchor plate affixed to a select one of the first window frame and the second window proximate a second end of the first and second members; and wherein the first and second anchor plates are adapted to be affixed to a structural support member extending substantially perpendicular to the first and second members of the mullion.

15. The window assembly of claim 13, further including:

a first L-shaped anchor plate affixed to a select one of the first window frame and the second window frame proximate a first end of the first and second members;

a second L-shaped anchor plate affixed to a select one of the first window frame and the second window proximate a second end of the first and second members; and a drip cap extending substantially orthogonal to the first and second member of the mullion, wherein the first and second anchor plates are affixed to the drip cap.

16. The window assembly of claim 13, further including:

at least one cover cap attached to at least a select one of the first window frame and the second window frame, the cover extending along and covering the mullion.

17. The window assembly of claim 16, wherein the cover cap includes a C-shaped cross-sectional geometry.

18. The window assembly of claim 17, wherein the cover cap includes a pair of engagement flanges that are snappingly received within the window frame.

19. The window assembly of claim 8, wherein the first portion of the first coupler and the second portion of the first coupler are snappingly coupled, and wherein the first portion of the second coupler and the second portion of the second coupler are snappingly coupled.

20. The window assembly of claim 8, wherein the first member extends substantially an entire length of the first window frame, and wherein the second member extends substantially an entire length of the second window frame.

21. The window assembly of claim 8, further including:

a first L-shaped anchor plate affixed to a select one of the first window frame and the second window frame proximate a first end of the first and second members; and a second L-shaped anchor plate affixed to a select one of the first window frame and the second window proximate a second end of the first and second members; and wherein the first and second anchor plates are adapted to be affixed to a structural support member extending substantially perpendicular to the first and second members of the mullion.

22. The window assembly of claim 8, further including:

a first L-shaped anchor plate affixed to a select one of the first window frame and the second window frame proximate a first end of the first and second members;

a second L-shaped anchor plate affixed to a select one of the first window frame and the second window proximate a second end of the first and second members; and a drip cap extending substantially orthogonal to the first and second member of the mullion, wherein the first and second anchor plates are affixed to the drip cap.

23. The window assembly of claim 8, further including:

at least one cover cap attached to at least a select one of the first window frame and the second window frame, the cover extending along and covering the mullion.

24. The window assembly of claim 23, wherein the cover cap includes a C-shaped cross-sectional geometry.

25. The window assembly of claim 24, wherein the cover cap includes a pair of engagement flanges that are snappingly received within the window frame.

* * * * *